US006022022A

United States Patent [19]

Smith

[11] Patent Number: 6,022,022

[45] Date of Patent: Feb. 8, 2000

[54] METHOD OF PLAYING A CARD GAME

[75] Inventor: Raymond Smith, West Haven, Conn.

[73] Assignee: Pick-It, Inc., West Haven, Conn.

[21] Appl. No.: 08/918,000

[22] Filed: Aug. 25, 1997

[51] Int. Cl.[7] ..... A63F 1/00

[52] U.S. Cl. ..... 273/292

[58] Field of Search ..... 273/292, 274; 463/12, 13

[56] References Cited

U.S. PATENT DOCUMENTS 4,362,303 12/1982 Pell ..... 273/274

5,713,573 2/1998 Nazaryan ..... 273/292

*Primary Examiner*—Benjamin H. Layno

*Attorney, Agent, or Firm*—Ware, Fressola, Van Der Sluys & Adolphson LLP

[57] ABSTRACT

A method of playing a card game includes the steps of providing at least one deck of cards comprising cards of at least two suits of a first color, and cards of at least two suits of a second color, the cards also having numerical values; providing at least one playing space for at least one player, the playing space having a plurality of indicators for indicating a combination of cards selected from the group consisting of card color, card suit, card numerical value, and combinations thereof; selecting at least one indicator for each player so as to provide each player with at least one player selected combination of cards; dealing three cards from the deck of cards to provide a dealt combination of card color, card suit and card numerical value; and comparing the dealt combination with the at least one player selected combination of cards, wherein the player is winner if the at least one player selected combination of cards includes the dealt combination.

7 Claims, 3 Drawing Sheets

METHOD OF PLAYING A CARD GAME

BACKGROUND OF THE INVENTION

The invention relates to a card game and, specifically, to a method for playing a card game wherein one or more players attempt to select a combination of cards to be dealt by a dealer.

Card games have been used as a source of amusement and entertainment for an extraordinarily long time. Such games can and have been played on a friendly basis between acquaintances, in locations such as casinos for wagering, and in countless other settings.

In the casino setting, card games are typically perceived as being difficult to play, and are therefore not played by a large number of casino patrons. Furthermore, typical casino card games involve the dealing of a large number of cards, and each hand therefore takes a significant amount of time. Further, when these games are played between multiple players, each player plays a different hand, and no jackpot is typically available.

From the standpoint of both the casino and players, the need remains for a simple, fast and self-playing card game which avoids the above-mentioned drawbacks.

It is therefore the primary object of the present invention to provide a method for playing a card game which is straight-forward and easy for players to understand.

It is a further object of the present invention to provide a method for playing a card game wherein a hand can be completed in a relatively short period of time.

It is still another object of the present invention to provide a method for playing a card game, in a casino setting, wherein a number of players play the same hand and can also simultaneously win a jackpot prize.

Other objects and advantages of the present invention will appear hereinbelow.

SUMMARY OF THE INVENTION

In accordance with the present invention, the foregoing objects and advantages are readily attained.

According to the invention, a method for playing a card game is provided, which method comprises providing at least one deck of cards comprising cards of at least two suits of a first color, and cards of at least two suits of a second color, said cards also having numerical values; providing at least one playing space for at least one player, said playing space having a plurality of indicators for indicating a combination of cards selected from the group consisting of card color, card suit, card numerical value, and combinations thereof; selecting at least one indicator for each player so as to provide each player with at least one player selected combination of cards; dealing three cards from said deck of cards to provide a dealt combination of card color, card suit and card numerical value; and comparing said dealt combination with said at least one player selected combination of cards, wherein said player is winner if said at least one player selected combination of cards includes said dealt combination.

In further accordance with preferred aspects of the present invention, a method is provided as set forth above wherein said plurality of indicators indicate combinations of cards consisting of (1) two cards of said first color and one card of said second color, (2) two cards of said second color and one card of said first color, (3) three cards of said first color of mixed suit, (4) three cards of said second color of mixed suit, (5) three cards all of the same suit, and (6) at least two cards of the same numerical value.

In still further accordance with the invention, different win levels may be assigned to each combination of cards, and the method of the present invention preferably further comprises assigning a plurality of win levels to combination (6) consisting of win level A for first and second cards of said dealt combination having the same numerical value and a different suit, win level B for first and second cards of said dealt combination having the same numerical value and the same suit, win level C for all three cards having the same numerical value and not the same suit, and win level D for all three cards having the same numerical value and the same suit, wherein win level D is greater than win level C, which is greater than win level B, which is greater than win level A.

BRIEF DESCRIPTION OF THE DRAWINGS

A detailed description of preferred embodiments of the invention follows, with reference to the attached drawings wherein.

DETAILED DESCRIPTION OF THE PREFERRED EMBODIMENT(S)

The present invention relates to a card game and, more specifically, to a method for playing a card game wherein players either in a friendly competitive setting or in a casino setting can enjoy a fast-paced and simple to play yet exciting card game.

The card game in accordance with the present invention is preferably played using one or more decks of conventional playing card which are typically divided into cards of one color, for example red, divided into two suits, for example diamonds and hearts, and cards of a second color, for example black, which are divided into two suits, for example spades and clubs. Further, each card preferably has a numerical value designated thereon as well, for example ranging between Ace through King, with one numerical value for each suit as is well known in conventional decks of playing cards. In accordance with the present invention, the card game is most preferably played using 3–8 complete decks of cards. Of course, other versions of the game may be played using different numbers of decks of cards, or cards tailored specifically to include cards of two colors and four suits in non-conventional manner, all within the scope of the present invention. Further, it is contemplated that the card game could be played electronically, using computer or otherwise generated images of cards rather than actual physical cards, also well within the scope of the present invention.

Figure 1:
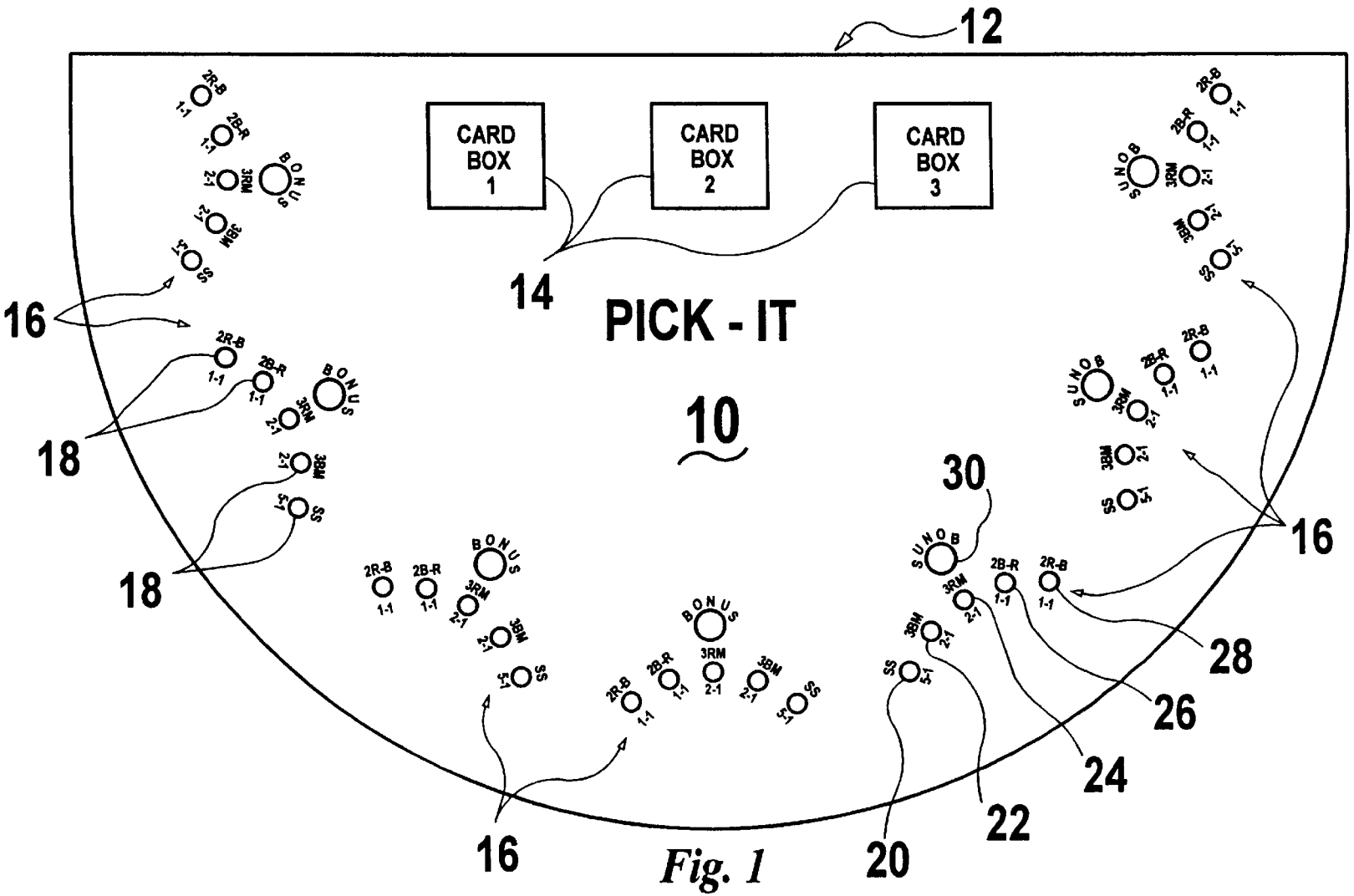
FIG. 1 is a schematic view of a playing area or game board for use in playing the card game of the present invention.

Referring now to the drawings, FIG. 1 shows a schematic illustration of a playing surface 10 for use in playing the card game of the present invention in a multi-player setting. Playing surface 10 as shown in FIG. 1 is designed to accommodate up to seven players as well as a dealer. As shown, playing surface 10 preferably has a dealing area 12 which includes three delineated areas 14 for receiving a combination of three cards to be dealt by the dealer. Delineated areas may specifically be indicated as boxes 1, 2 and 3 for use in playing the game of the present invention, as will be further discussed below.

Also as shown in FIG. 1, playing surface 10 includes a plurality of different playing areas 16 provided with an array of indicators to be used by one or more players to predict a combination of cards to be dealt by the dealer in dealing area 12.

Figure 2:
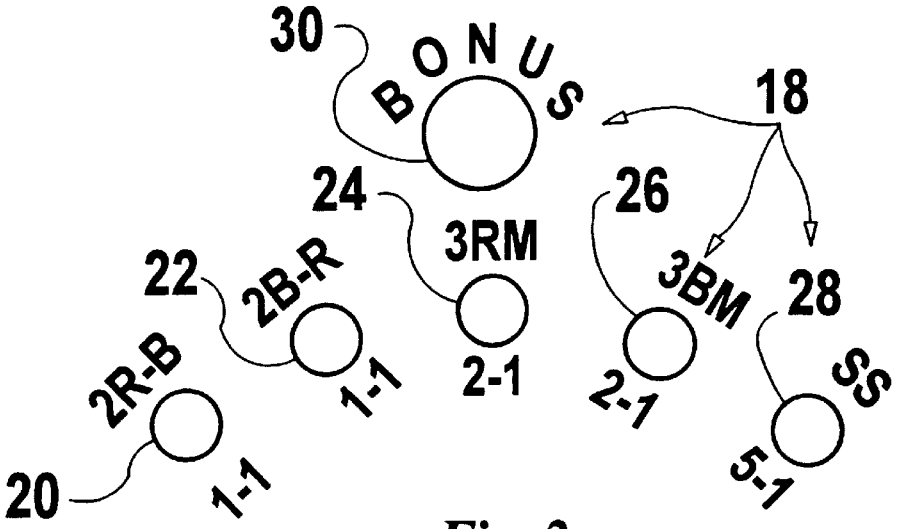
FIG. 2 is an enlarged portion of the game board of FIG. 1.

Referring to FIG. 2, one playing area 16 is enlarged so as to enhance the further description thereof. In accordance with the method of the present invention, players playing the subject card game are allowed to choose or select one or more indicators 18 placed within playing area 16, for example by placing a chit or token or some other object on the desired indicator 18.

In accordance with the present invention, each playing area 16 is preferably provided with indicators 18 for selecting combinations of cards consisting of (1) two red cards and one black card, (2) two black cards and one red card, (3) three red cards of mixed suit, (4) three black cards of mixed suit, (5) three cards all of the same suit, and (6) a bonus selection based upon at least two cards of the dealt combination having the same numerical value.

Indicators 18 are also preferably provided with a win level in accordance with the present invention. As shown in FIG. 2, the win level may be presented as a representation of odds associated with each indicator 18. As shown in FIG. 2, for example, the win level for properly selecting either two red and one black, or two black and one red cards is preferably 1-1. Also as shown, the win level for properly selecting either three red mixed or three black mixed cards is 2-1, and the win level for properly selecting three cards all of the same suit is 5-1. This win level could be used in a casino setting to indicate pay odds to a winning player, or could be used to determine the highest level of winner in a friendly competition, or the like.

In further accordance with a preferred embodiment of the present invention, indicator 18 for use in indicating a bonus or jackpot selection is preferably assigned a plurality of win levels consisting of a first win level A for first and second cards of the dealt combination having the same numerical value but being of a different suit, win level B for first and second cards of the dealt combination having the same numerical value and the same suit, win level C for all three dealt cards having the same numerical value and not the same or mixed suit, and win level D for all three cards having the same numerical value and the same suit. In further accordance with the invention, win level D is preferably greater than win level C, which is greater than win level B, which is greater than win level A. In other words, win level D>win level C>win level B>win level A.

Figure 3A:
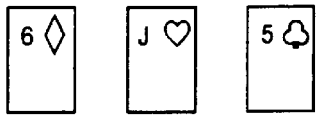
FIGS. 3A–3E illustrate various combinations of cards which can be selected in accordance with the method of the present invention.

Referring now to FIGS. 3A–3E, combinations of cards representing each of the indicators of FIG. 2 except the bonus indicator are illustrated. FIG. 3A shows a combination of cards corresponding to specific indicator 20 as shown in FIG. 2. In FIG. 3A, a six of diamonds (red), jack of hearts (red) and five of clubs (black) are shown. Thus, this card grouping corresponds to indicator 20, two red one black. Although the cards shown in FIG. 3A are arranged with the two red cards first, the red cards need not be the first two cards in accordance with the present invention. Thus, if the five of clubs in this example were drawn second, the card combination would still be represented by indicator 20.

Figure 3B:
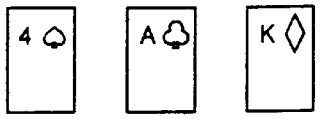

Referring to FIG. 3B, a combination of cards corresponding to indicator 22 is shown. In accordance with the invention, indicator 22 is used to predict a two black, one red card outcome. As shown in FIG. 3B, a four of spades (black), a king of clubs (black) and ace of diamonds (red) are shown representing two black and one red card.

Figure 3C:
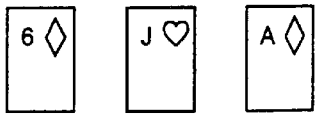

FIG. 3C shows a combination of cards corresponding to indicator 24 which is used to predict a combination of three red cards of mixed suit. As shown in FIG. 3C, an example of such a combination of cards could be a six of diamonds, jack of hearts and ace of diamonds, which are all red but of mixed suit.

Figure 3D:
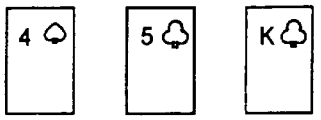

Referring now to FIG. 3D, a combination of cards is shown which corresponds to indicator 26 for use in predicting a combination of three black cards of mixed suit. As shown, FIG. 3D shows a combination of cards including four of spades, king of clubs and five of clubs, each of which is a black card, but of mixed suit.

Figure 3E:
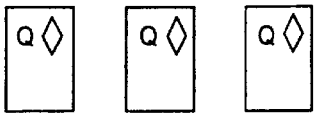

Referring to FIG. 3E, a combination of cards is shown which corresponds to indicator 28 for use in accordance with the present invention in predicting a combination of cards all of the same suit. FIG. 3E shows a six, ten and ace all of diamonds.

Thus, FIGS. 3A–3E show exemplary combinations of cards corresponding to each of indicators 20–28 in accordance with the present invention.

Figure 4A:
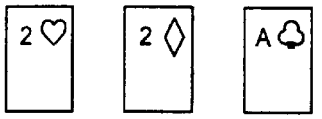
FIGS. 4A–4D illustrate further combinations of cards which can be selected in accordance with the method of the present invention.
Figure 4B:
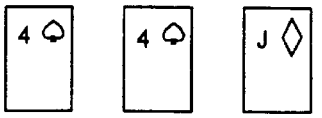
Figure 4C:
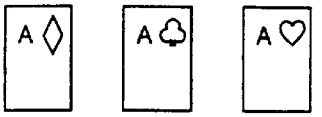
Figure 4D:
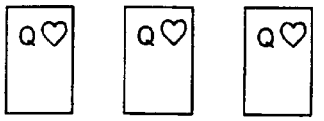

Referring now to FIGS. 4A–4D, combinations of cards corresponding to each win level assigned to bonus indicator 30 are provided. In accordance with the present invention, bonus indicator 30 can preferably be used by one or more players to predict a jackpot combination of cards wherein at least the first two cards have the same numerical value. In further accordance with the invention, four distinct win levels each starting with two cards of the same numerical value are assigned different win levels. FIG. 4A illustrates a combination of cards corresponding to win level A, wherein the first and second cards have the same numerical value, in this case a two, but are of a different suit. FIG. 4B shows win level B in accordance with the present invention, wherein the first and second cards only have the same numerical value, in this case a four, and also have the same suit, spades. FIG. 4C illustrates win level C wherein all three cards have the same numerical value, in this case an ace, but are of mixed suit. Finally, FIG. 4D illustrates a combination of cards corresponding to win level D of bonus indicator 30, wherein all three cards have the same numerical value, in this case a queen, and are of the same suit. As set forth above, win level D in accordance with the present invention is assigned the greatest bonus value and win level A is assigned the least bonus value. In accordance with the embodiment of the present invention wherein indicators 20–28 are assigned actual odds numbers as shown in FIG. 2, win level A is preferably assigned an odds value of 5-1, win level B is preferably assigned an odds value of 25-1, win level C is preferably assigned an odds value of 100-1, and win level D is preferably assigned an odds value of 1,000-1.

Figure 5:
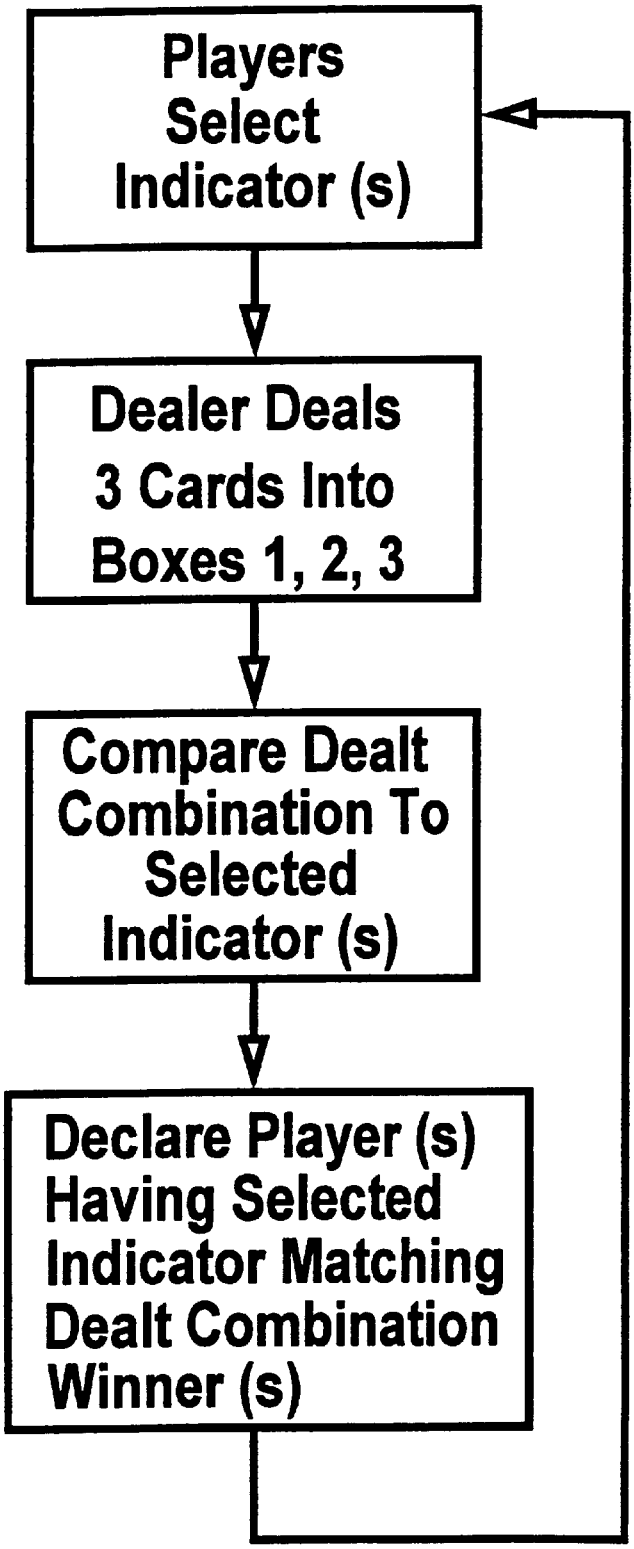
FIG. 5 schematically illustrates the flow of play of the card game in accordance with the present invention.

Referring now to FIG. 5, a schematic of a series of steps of play of the card game in accordance with the present invention is provided along with further description of same. To begin the game, a deck or number of decks of cards are preferably provided, and are shuffled and placed in an appropriate location from which cards can be dealt during play of the game. In a non-casino setting, any player could act as dealer, and no specific procedure need be followed for dealing cards. In a casino setting, a non-playing dealer is preferably provided who shuffles and prepares the cards for being dealt from a shoe or other device.

When the cards are ready to be dealt, the game begins by each player selecting one or more indicators in that player's assigned playing area 16, for example by placing a token, chit or the like on a particular indicator or indicators 20–30. As set forth above, each player may select one or more indicators set forth in playing area 16. When all players have selected their desired indicators 18, the dealer then deals three cards, preferably into dealing area 12 and specifically delineated areas 14 for the dealt combination of cards so as to provide a readily visible display of the three cards corresponding to the dealt combination. The dealer then compares the dealt combination with the indicators selected by each player, and declares any player having a selected indicator corresponding to the dealt combination as a winner. It should be readily apparent that any number of players can win simultaneously on each hand. Further, and advantageously, bonus indicator 30 provides a jackpot which can be won simultaneously by any and all players playing at playing surface 10. Once the dealt combination of cards from dealing area 12 has been compared to the selected indicators of each player, the process is repeated by having players re-select desired indicators, and the dealer again dealing three new cards for a new dealt combination of cards.

In a casino setting, in order to verify when jackpots corresponding to bonus indicator 30 have been won by players, it is preferred in accordance with the present invention that the dealer deal cards into delineated areas 14 sequentially, and that the dealer call for a supervisor when cards dealt into boxes 1 and 2 in delineated areas 14 are of the same numerical value so as to confirm that some jackpot has been won. Of course, in non-wagering or non-casino setting games, this step is most likely unnecessary.

In further accordance with the present invention, it is contemplated that the game of the present invention could be played using generated images or other representation of cards, rather than actual cards themselves. For example, cards could be randomized and dealt through random selection and image generation using computers and the like, all within the scope of the present invention.

It should also be noted that although FIG. 1 shows playing surface 10 having seven playing areas 16, playing surface 10 could be provided with a different number of playing areas 16 as desired.

It should also readily be appreciated that in accordance with the present invention, a method for playing a card game has been provided which is both fast and simple to play, and is therefore exciting to a broader spectrum of players, and which is also quickly played so as to allow the maximum number of hands to be dealt over a particular period of time which is advantageous, for example, to casino operators.

It should also be noted that although the cards discussed above are specified as having a numerical value, i.e., A, 2, 3, 4, 5, 6, 7, 8, 9, 10, J, Q, K, cards could be used equally well within the scope of the invention having some other differentially indicator, numeric, pictorial or otherwise, for use in identifying cards having the same or different value.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of playing a card game wherein a first card is dealt, then a second card is dealt, then a third card is dealt sequentially to form a dealt three card combination, comprising the steps of:

providing at least one deck of cards comprising cards of at least two suits of a first color, and cards of at least two suits of a second color, said cards in each suit also having all numerical values in the range of Ace, 2, 3, 4, 5, 6, 7, 8, 9, 10, Jack, Queen, and King, inclusive;

providing at least one playing space for at least one player, said playing space having a plurality of indicators for indicating a combination of cards selected from the group consisting of card color, card suit, card numerical value, and combinations thereof;

providing said at least one playing space with a bonus indicator, said bonus indicator identifying a bonus condition including said first card dealt and said second card dealt of said dealt three card combination having the same numerical value;

selecting at least one indicator for each player so as to provide each player with at least one player selected combination of cards;

offering each player an opportunity to select said bonus indicator concurrently with said selection of at least one indicator;

sequentially dealing a first card, then dealing a second card, then dealing a third card from said deck of cards to provide a dealt three card combination of card color, card suit and card numerical value;

comparing said dealt combination with said at least one player selected combination of cards, wherein said player is winner if said at least one player selected combination of cards includes said dealt combination;

comparing said dealt combination with a bonus table to identify a bonus condition; and awarding said player a bonus, conditioned upon said player previously having selected said bonus indicator and wherein said dealt combination comprises a bonus condition.

2. A method according to claim 1, wherein said plurality of indicators indicate combinations of cards consisting of (1) two cards of said first color and one card of said second color, (2) two cards of said second color and one card of said first color, (3) three cards of said first color of mixed suit, (4) three cards of said second color of mixed suit, (5) three cards all of the same suit, and (6) at least two cards of the same numerical value.

3. A method according to claim 2, further comprising assigning a win level to each of said combinations of cards.

4. A method according to claim 3, further comprising assigning a plurality of win levels to combination (6) consisting of win level A for first and second cards of said dealt combination having the same numerical value and a different suite, win level B for first and second cards of said dealt combination having the same numerical value and the same suit, win level C for all three cards having the same numerical value and mixed suit, and win level D for all three cards having the same numerical value and the same suit, wherein win level D is greater than win level C, which is greater than win level B, which is greater than win level A.

5. A method according to claim 1, wherein said providing step comprises providing between about 3 to about 8 decks of cards.

6. A method according to claim 1, wherein said providing step comprises providing a plurality of playing spaces for a plurality of players, wherein said selecting step comprises selecting at least one indicator for each player of said plurality of players, and wherein said comparing step comprises comparing said dealt combination with said at least one player selected combination of cards for each player of said plurality of players, wherein each player having said player selected combination of cards including said dealt combination is winner.

7. A method according to claim 1, wherein said bonus condition is identified by combinations of cards consisting of (1) the first and second cards have the same numerical value but are of a different suit; (2) the first and second cards have the same numerical value and are of the same suit; (3) the first three cards have the same numerical value, but are not of the same suit; and (4) the first three cards have the same numerical value and are of the same suit.

* * * * *